US006085952A

United States Patent [19]

Garland

[11] Patent Number: 6,085,952

[45] **Date of Patent: *Jul. 11, 2000**

[54] TOOL HOLDER FOR FISHERMEN AND TRADESMEN

[76] Inventor: Gordon David Garland, 283 Arlington Avenue, Toronto, Ontario, Canada, M6C 2Z8

[ * ] Notice: This patent is subject to a terminal disclaimer.

[21] Appl. No.: 08/292,031

[22] Filed: Aug. 18, 1994

Related U.S. Application Data

[63] Continuation-in-part of application No. 07/931,358, Aug. 18, 1992, Pat. No. 5,388,740.

[30] Foreign Application Priority Data

Aug. 18, 1993 [CA] Canada ..... 2097362

[51] Int. Cl.[7] ..... A45F 5/00

[52] U.S. Cl. ..... 224/253; 224/242; 224/904; 224/907; D3/220; D3/228; D3/230

[58] Field of Search ..... 224/250–253, 224/255, 269, 197, 904, 911, 912, 914, 232, 234, 224, 226, 228, 242–243, 245–246; 2/250; D3/220, 228, 230, 218, 210, 38, 102; 24/3 M, 192, 193, 197, 198

[56] References Cited

U.S. PATENT DOCUMENTS

| | | | |
|---|---|---|---|
| 1,370,636 | 3/1921 | Dwyer | 224/616 |
| 2,500,525 | 3/1950 | De Buigne | 224/232 |
| 2,543,313 | 2/1951 | Dietzgen | 224/675 |
| 2,653,038 | 9/1953 | Dyer | 224/235 |
| 3,200,021 | 8/1965 | Clark | 224/911 |
| 3,261,519 | 7/1966 | Horne | 224/911 |
| 3,970,228 | 7/1976 | Keller | 224/675 |
| 4,327,850 | 5/1982 | Robinson, Jr. | 224/616 |
| 4,350,274 | 9/1982 | Morgan | 224/616 |
| 4,917,281 | 4/1990 | Ostermiller | 224/675 |
| 5,050,786 | 9/1991 | DeMott | 224/930 |
| 5,282,559 | 2/1994 | Wisser et al. | 224/243 |

FOREIGN PATENT DOCUMENTS

| | | | |
|---|---|---|---|
| 1139775 | 11/1962 | Germany | 224/911 |
| 188999 | 4/1937 | Switzerland | 224/226 |

*Primary Examiner*—Henry J. Recla
*Assistant Examiner*—Timothy L. Maust

[57] ABSTRACT

The present invention provides for a tool holder for use by fishermen, handymen and the like. The tool holder comprises a holster portion having a pocket of a size for holding a tool, the pocket being formed from a front and base connected together along the sides thereof and having an open top. The tool holder includes a belt loop portion for attaching the holder to the belt of a user. The holster portion is suspended from the belt loop portion through a moveable connection which allows the holster portion movement from front to back and side to side simultaneously. This allows the holster portion to remain suspended in a generally vertical orientation independent of the movement of the user thereby reducing the possibility of interference of the holster to freedom of movement of the user.

12 Claims, 3 Drawing Sheets

TOOL HOLDER FOR FISHERMEN AND TRADESMEN

This application is a continuation in part of Ser. No. 07/931,358, filed Aug. 18, 1992, now U.S. Pat. No. 5,388,740, issued Feb. 14, 1995.

FIELD OF THE INVENTION

The present invention relates to a tool holder for use by fishermen, tradesmen and homeowners. In particular, the invention relates to a tool holder for use by fishermen, tradesmen and homeowners which allows for secure carrying of tools while not restricting freedom of movement of the user.

BACKGROUND OF THE INVENTION

Holders and holsters for tools such as pliers, wrenches, knives, etc., have been known for a number of years. Such holders or holsters generally have a pocket or other means for holding the tool and a loop or other means for attaching the holder or holster to a belt. Examples of such holders are found in U.S. Pat. Nos. 2,500,525, 2,664,321, 2,783,536, 2,859,516 3,516,584, and Des 281,896. Such holders may be provided with closure means to aid in retaining the tool in the holder such as that for example shown in U.S. Pat. No. 1,088,406. Some such holders may also be provided with various moveable means for allowing for movement of the holder such as for example shown in U.S. Pat. No. 2,387,900 where a sheath is mounted pivotally on a supporting member. However, such known examples of holders do present some difficulties for the user. Holders typically made of leather or other soft material may be too flexible and the holder may bend when the tool is removed from the pocket thereby interfering with the ease of removal of the tool from the pocket. Typical moveable attachments generally do not provide for the flexibility of movement which may be required so that the holder does not interfere with the user's freedom of movement when bending, squatting, sitting or moving about in brush or in a boat or other vessel. In other cases, holders may be of one piece design and too rigid, either with or without the tool inserted, resulting in interference with the movement of the wearer.

SUMMARY OF THE INVENTION

The present invention provides for a tool holder comprising a holster portion having a pocket of a size for holding a tool, the pocket being formed from a front and base connected together along the sides thereof and having an open top and a belt loop portion for attaching the holder to the belt of a user. The holder is suspended from the belt loop portion by a connecting means which provides for front to back and side to side movement independently and simultaneously such that the holster portion remains suspended generally vertically independent of the movement of the user. The connecting means allows freedom of movement of the holster thereby reducing the possibility of interference of the holster to freedom of movement of the user.

In an aspect of the invention there is provided a tool holder for use by fishermen, handymen and the like comprising a holster portion having a pocket of a size for holding a tool, the pocket being formed from a front and base connected together along the sides thereof and having an open top. The holster portion is constructed of a soft material and the base near the top is provided with a stiffening means to provide stiffness to substantially reduce bending or folding when a tool is inserted or removed from the pocket. The holder further includes a belt loop portion for attaching the holder to the belt of a user. The holster portion is suspended from the belt loop portion through a connecting means which allows the holster portion movement from front to back and from side to side simultaneously such that the holster portion remains suspended by the connecting means below the belt loop portion in a generally vertical orientation independent of the movement of a user thereby reducing the possibility of interference of the holster to freedom of movement of the user.

In yet another aspect of the invention there is provided a tool holder for use by fishermen, handymen and the like comprising a holster portion having a pocket of a size for holding a tool, the pocket being formed from a front and base connected together along the sides thereof and having an open top. The holder further includes a belt loop portion for attaching the holder to the belt of a user, attached to the holster portion through a moveable connection. The belt loop portion comprises a lower end having a means for engaging the moveable connection and further includes a first part of a two-part releasable securing means attached to the back of the lower end. The belt loop portion also has a loop portion for engagement with a belt extending upwardly and rearwardly of the lower end and ending in a grasping end, the second part of the two-part releasable securing means being attached to the inside of the loop portion near the grasping end. When the belt loop portion is attached to a belt, the grasping end and two-part releasable securing means are located between the loop portion and the wearer of the belt thereby protecting the releasable securing means from accidental disengagement or interference with the operation of the holder.

BRIEF DESCRIPTION OF THE DRAWINGS

The above as well as other advantages and features of the present invention will be described in greater detail according to preferred embodiments of the present invention in which.

DETAILED DESCRIPTION OF THE PREFERRED EMBODIMENTS

Figure 1:
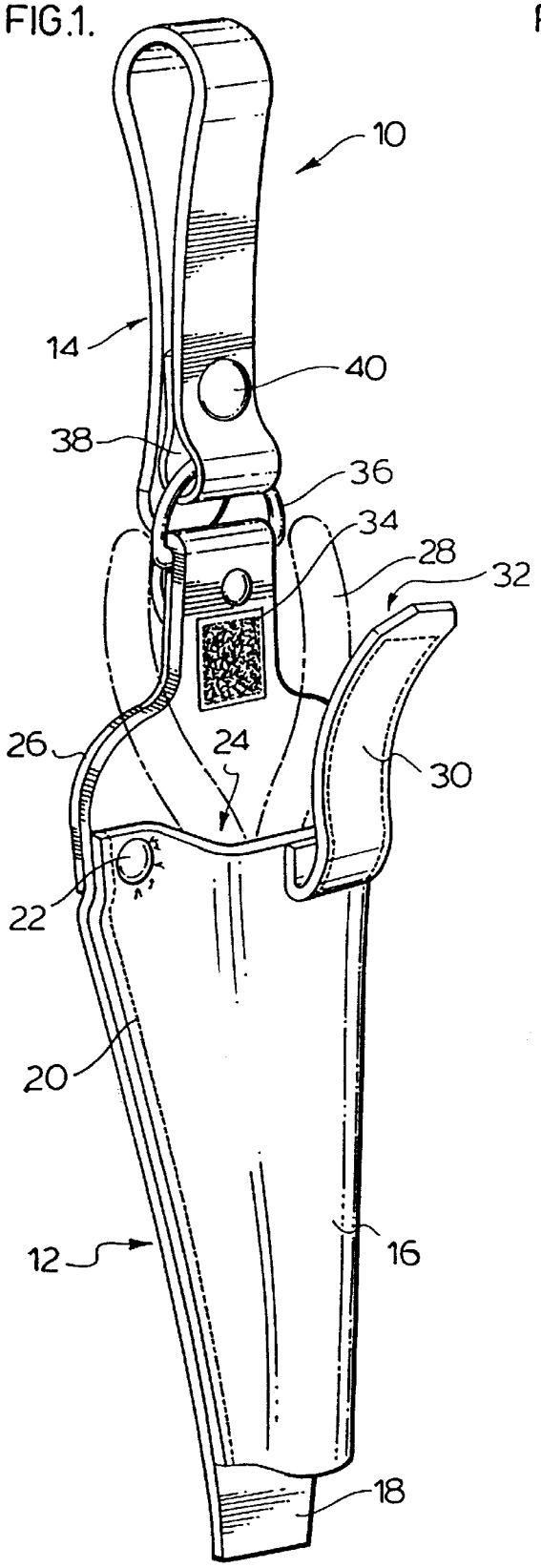
FIG. 1 is a perspective view illustrating a first embodiment of the present invention.
Figure 2:
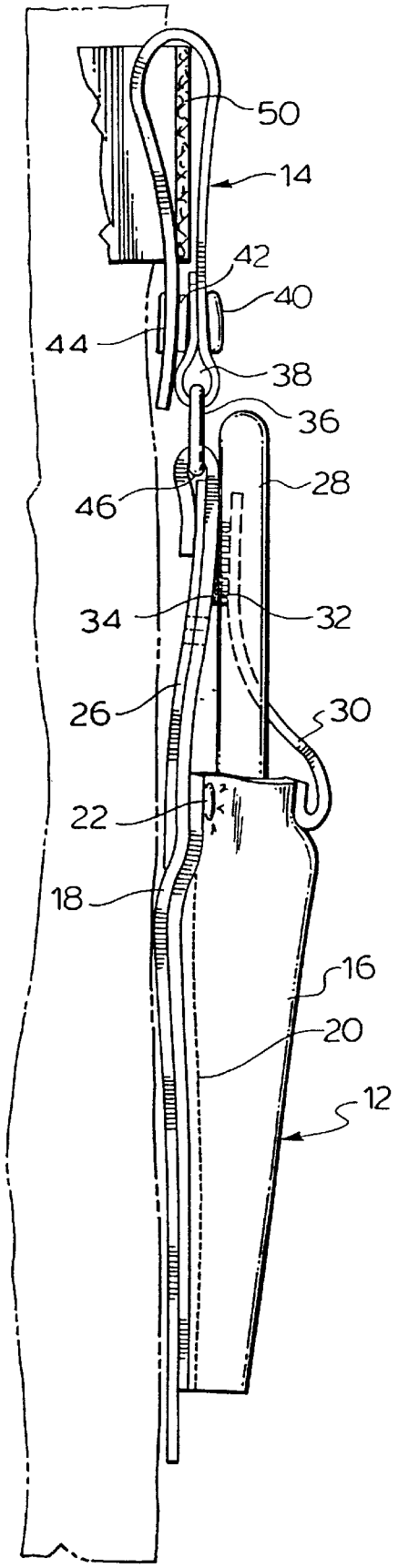
FIG. 2 is a side view of the embodiment of FIG. 1 attached to a belt of a user.

A preferred embodiment of the tool holder of the present application adapted for use with pliers is shown in FIGS. 1 and 2 generally indicated at 10. The holder comprises a holster portion 12 and a belt loop portion 14. The holster portion 12 has a front 16 and a base 18 attached together along the sides to form a pocket 24. Preferably the front 16 and a base 18 are formed of two pieces of leather, stitched together along the sides thereof by stitching 20. More preferably, in order to provide for reinforcement at the stress points, namely the corners at the top of the pocket 24, the stress points are reinforced by the use of rivets 22. The pocket 24 has an open top and preferably also has an open bottom. The pocket 24 is also preferably shaped to follow generally the contours of the tool for which the holder is designed. Thus for a pliers holder, the pocket 24 is shaped to follow the general shape of the head and grasping handle of the pliers. More preferably, the pocket is sized to accommodate a range of sizes of pliers such as 5 inch to 8 inch long nosed pliers, 5 to 6 inch straight surgical forceps, 5 inch curved surgical forceps and a wide range of specialty pliers including needle nosed pliers, chain nosed pliers, diagonal pliers, side cutting pliers and electronic pliers and other similar shaped tools such as scissors and shears.

The holster portion may be provided with a tongue closure 30 attached at one end thereof to the front 16 of the holster. The other end of the tongue closure 30 is provided with a grasping end and one part of a two part complementary releasable securing means 32, the second part of the two part releasable securing means 34 being attached to the base 18 of the holster above the pocket 24. The two-part releasable securing means could be a typical male-female snap arrangement. However, for ease of use the two-part securing means is preferably a fabric loop 32 and hook 34 system such as that sold under the trade-mark VELCRO. By attaching the closure tongue 30 permanently to the front 16 and providing for the releasable securing means to attach to the base 18 above the pocket 24, the closure tongue 30 falls away from the open top of the pocket 24 when the tongue is in its open position and therefore the tongue does not interfere with either easy insertion of an instrument into the holder or easy extraction of an instrument from the holder. The positioning of the loop portion 32 of the velcro on the tongue 30 and the hook portion 34 on the base 12 substantially reduces the possibility of the hook side catching on foreign material. The free end of the tongue 30 when in the closed position is centrally located between the handles of a pliers 28 and protected from coming into contact with projecting objects and thus inadvertently opening.

The holster portion 12 when constructed of a soft material such as leather, is preferably provided with a stiffening means 26 secured to the upper base 18 of the holster portion 12. The stiffening means 26 reinforces the upper base 18 of the holster 12 making it stronger and more rigid thereby preventing it from folding under when heavier and larger pliers are extracted from the pocket 24. In order to provide for durability and weather resistance, the stiffening means is preferably a durable, crack-resistant plastic such as, for example, a relatively stiff polyolefin.

The holster portion 12 is suspended from a belt loop portion 14 by a connecting means which provides for movement in more than one direction independently and simultaneously at one point. The connecting means allows freedom of movement of the holster thereby reducing the possibility of interference of the holster to freedom of movement of the user. Preferably, the connecting means between the holster 12 and belt loop 14 is provided by a D ring 36 connecting the two portions together. The belt loop 14 is permanently attached to the semi circular side of the D-ring 36 by means of a much smaller loop 38 at its lower end which is created by bending the belt loop material under the semi circular side of the D-ring 36 and permanently closing the small loop 38 with a dome rivet 40 so that the smaller loop 38 is of sufficient size to permit the semi circular side of the D-ring 36 to move freely in two directions, horizontally along the length of the circular side of the D-ring 36 and laterally across the width of the D-ring material and at right angles to the horizontal plane. Thus, the belt loop 14 and in particular, the smaller loop 38, act as a pivot means allowing the circular side of the D-ring 36 to pivot, swing, rotate and/or swivel in two directions, from front to back and side to side, independently or simultaneously. The straight side of the D-ring 36 attached to the holster by means of a second loop 46 also allows for the holster to swing about the straight portion at right angles to the D-ring 36.

The belt loop 14 has a loop portion provided with a releasable securing means at the end thereof so that the holder 10 can be attached to a belt 50 without the wearer having to remove the belt 50 to attach or detach the tool holder 10. The belt loop 14 is secured to the belt 50 by means of a two part connection system such as a female snap connector 42 on the back side of both the dome rivet 40 and the smaller loop 38 and a male snap connector 44 at the inside of the belt loop 14 near its end closest to the wearer, thereby permitting installation and removal of the belt loop without removal of the belt 50, and without permitting the grasping end of the belt loop 14 to interfere with either the movement of the D-ring 36 or the extraction or insertion of the holster's contents. The releasable belt loop 14 is preferably provided with a grasping end to permit fast separation of the snap fasteners 42 and 44.

As will be observed from the figures, the orientation of the releasable securing means and grasping end for release of the belt loop portion is reversed from what would be considered the traditional or normal orientation, namely, having the grasping end and securing means for release of the belt loop portion on the part of the loop of the belt loop portion which would be outside of the belt. The present invention locates the grasping end of the loop portion to the interior of the belt closest to the wearer thus enabling a tool to be inserted into or extracted from the holster without snagging on the grasping end of the belt loop portion. In addition, this orientation protects the grasping end of the belt loop portion from accidental release and potential loss of the holder and tool. It also presents less protruding surfaces to potentially snag on, for example, brush as the wearer is moving. The protection of the grasping end and releasable securing means would be of even greater value should it be desired to replace the snap connector releasable securing means illustrated in the figures with, for example, a VELCRO™ type releasable securing means.

The holster 12 is preferably constructed of a soft material and owing to the stresses to which it will be subjected particularly from weather and wetness, more preferably the material is a leather such as a 5½ ounce chromium tan leather. This leather provides the holster and fastening tab with strength, the ability to withstand repeated wetting and adverse weather conditions without cracking and non-shrink, non-stretch properties. The belt loop 14 similarly is made from a soft yet stiffer material such as 7.5 to 8.5 ounce vegetable tan English bridle leather. This leather has strength, workability and the ability to withstand adverse weather conditions and provides the belt loop 14 with its required strength and stiffness. To provide for the ability to expand and contract with the leather when exposed to the elements, the thread used for the stitching 20 is preferably a linen thread. In order to reduce the possibility of rust upon exposure to the elements the D-ring 36 and rivets 22 are preferably constructed of brass or similar such relatively weather resistant metals or plastic.

Figure 3:
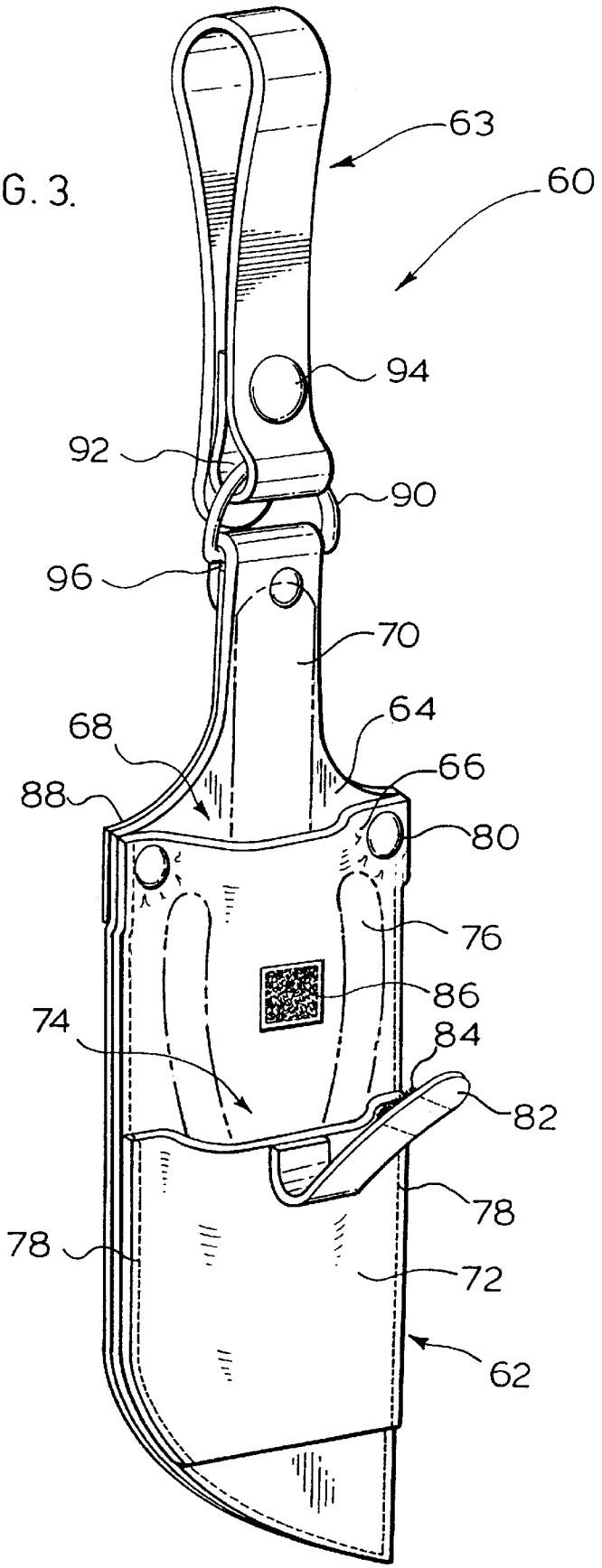
FIG. 3 is a perspective view of a second embodiment of the present invention.

A second embodiment of the tool holder of the present invention is illustrated in FIG. 3, generally indicated as 60. The holder comprises a holster portion 62 and a belt loop portion 63. Holster portion 62 has a base 64 to which is attached a first front portion 66 to form a first pocket 68 for holding a tool for example a knife 70 shown in dotted outline. Holster portion 62 also includes a second front portion 72 attached to the first front portion 66 to form a second pocket 74 for holding of a second tool such as for example the pliers 76 shown in outline. The first front portion 66 and second front portion 72 are attached to the base 64 by means of stitching 78 and rivets 80 at the stress points at the corners of the top of first pocket 68. Although not illustrated in the figure, more rivets may be provided at the stress points at the top of the second pocket 74. First pocket 68 has a open top and depending upon the tool to be used in the pocket may have an open bottom. In the embodiment illustrated for a knife, the bottom of the first pocket 68 is closed off to prevent slipage of the knife through the pocket. Second pocket 74 is provided with an open top and preferably also has an open bottom. Pockets 68 and 74 are preferably shaped to follow generally the contours of the tools for which the holder is designed.

The holster portion 62 may be provided with at least one tongue closure attached at one end thereof to a front portion at the holster. In the embodiment illustrated a tongue closure 82 is attached at one end to the second front 72 of the holder portion 62. The other end of the tongue closure 82 is provided with a grasping end and one part 84 of a two part complimentary releasable securing means, the second part of the two part releasable securing means 86 being attached to the exterior of the first front portion 66. As in the first embodiment, the two part securing means is preferably a fabric loop 84 and hook 86 system such as that sold under the trade mark VELCRO.

The holster portion is provided with a stiffening means 88 secured to the upper base 64 of the holster portion to reinforce the upper base of the holster making it stronger and more rigid thereby preventing it from folding under when tools are extracted from the pocket 68.

The holster portion 62 is suspended from the belt loop portion 63 by a connecting means such as D-ring 90 which provides movement in more than one direction independently and simultaneously. The belt loop 63 is permanently attached to the semicircular side of the D-ring 90 by means of a smaller loop 92 with a dome rivet 94, in a manner as described above for the first embodiment. The straight side of the D-ring 90 is attached to the holster by means of a second loop 96 in a manner as described above. The belt loop 63 is provided with a releasable securing means at the bottom thereof similar to the first embodiment so the holder can be attached to a belt without the wearer having to remove the belt to attach or detach the holder 60.

Figure 4:
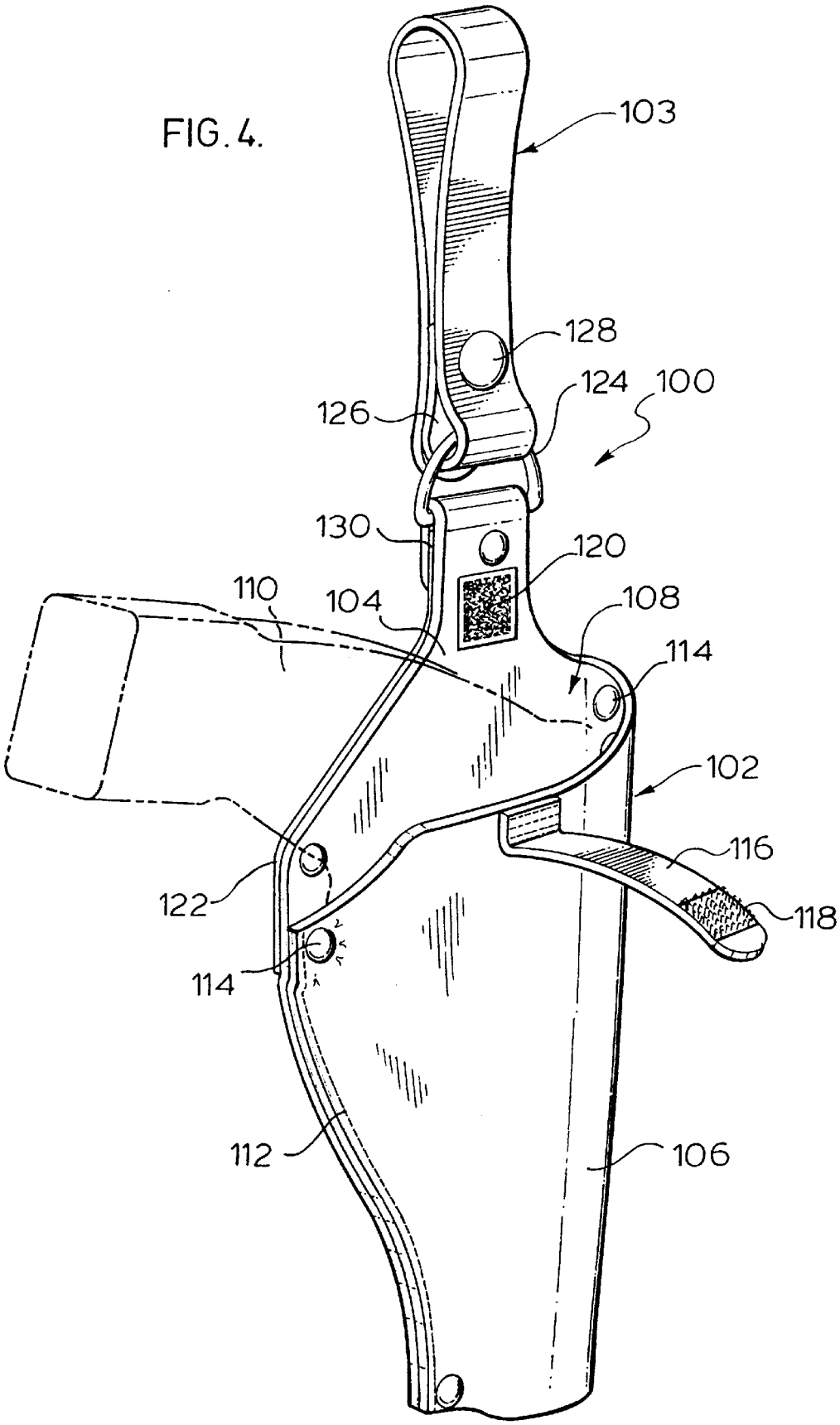
FIG. 4 is a perspective view of a third embodiment of the present invention.

A third embodiment of the present invention is illustrated in FIG. 4, generally indicated at 100. The holder comprises a holster position 102 and a belt loop portion 103. Holster portion 102 has a base 104 to which is attached a front portion 106 to form a pocket 108 for holding a large tool such as for example a cordless drill 110 shown in dotted outline. The front portion 106 is attached to the base 104 by means of stitching 112 and rivets 114 at the stress points at the corners of the top and bottom of first pocket 108. Pocket 108 has a open top and preferably also has an open bottom. Pocket 108 is preferably shaped to follow generally the contours of the tool for which the holder is designed.

The holster portion 102 may be provided with at least one tongue closure 116 attached at one end thereof to the front portion 106 of the holder portion 102. The other end of the tongue closure 116, if provided, has a grasping end and one part 118 of a two part complimentary releasable securing means. The second part of the two part releasable securing means 120 being attached to the base 104. As in the first embodiment the two part securing means is preferably a fabric loop 118 and hook 120 system such as that sold under the trade-mark VELCRO.

The holster portion is provided with a stiffening means 122 secured to the upper base 104 of the holster portion 102 to reinforce the upper base of the holster making it stronger and more rigid thereby preventing it from folding under when tools are extracted from the pocket 108.

The holster 102 is suspended from the belt loop portion 103 by a connecting means such as D-ring 124 which provides for movement in more than one direction independently and simultaneously. The belt loop 103 is permanently attached to the semicircular side of the D-ring 124 by means of a smaller loop 126 with a dome rivet 128 in a manner as described above for the first embodiment. The straight side of the D-ring 124 is attached to the holster 102 by means of a second loop 130 in a matter as described above. The belt loop 103 is provided with a releasable securing means at the bottom thereof similar to the first embodiment so the holder can be attached to a belt without the wearer having to remove the belt to attach or detach the holder 100.

The present invention provides for a tool holder that allows freedom of movement for the wearer of the holder accomplished through the use of the movable connection, in particular the D-ring, between the belt loop and the holster. The holder fits a wide range of tools including pliers and forceps used by fishermen or anglers, tradesmen and home handymen, knives, scissors and shears and cordless tools such as drills and screwdrivers. In a preferred embodiment for pliers and forceps, the holster is able to accommodate 5 to 8 inch long nosed pliers, 5 to 6 inch straight surgical forceps, 5 inch curved surgical forceps. By providing the holster with a narrow open bottom, ease of drainage of water from the holster should the holster be inadvertently submerged in the water is permitted. The present invention in a preferred embodiment also provides for a holder having a quick opening closure that secures the tool but does not interfere with extraction or insertion of the tool when the closure is in the opened position. This is accomplished through the use of the closure tongue attached to the holster front and the releasable securing means releasable securing the tongue to the holster base. By providing such an arrangement, the tool may be removed from the holder by the wearer grasping the free end of the tongue and pulling to release the tongue. Alternately, the user may simply pull the tool out of the holster as the tool in the process of being removed from the holder provides a cam surface to release the tongue from attachment to the base. The leather and stitching of the preferred embodiment of the holder resists cracking and will continue to retain its characteristics even under wet weather conditions. The holder may be easily used by anglers, trades people and home handymen to carry a wide range of tools including pliers or forceps so that they do not interfere with the wearer's movements, can be easily located, accessed and returned to a normal location. The holder does not restrict the movements of a user whether walking, wading, bending or sitting in a boat and the stiffening means or backing aids in the easy insertion and extraction of the tools without the holder bending or in other ways interfering with the extraction.

Although various preferred embodiments of the present invention have been described herein in detail, it will be appreciated by those skilled in the art that variations may be made thereto without departing from the spirit of the invention or the scope of the appended claims.

I claim:

1. A tool holder for use by fishermen, handymen and the like comprising:

a holster portion having a pocket of a size for holding a tool, the pocket being formed from a front and base connected together along the sides thereof and having an open top, wherein the sides of the front and base forming the pocket taper from the top to an bottom, a belt loop portion for attaching the holder to the belt of a user, the holster portion and the belt loop portion each being movably attached to a connecting means, the holster portion being suspended from the belt loop portion through the connecting means to allow the holster portion movement from front to back and from side to side simultaneously such that the holster portion remains suspended by the connecting means below the belt loop portion in a generally vertical orientation independent of the movement of a user thereby reducing the possibility of interference of the holster to freedom of movement of the user.

2. A tool holder as claimed in claim 1 wherein the connecting means between the holster and belt loop portions is provided by a D ring connecting the two portions together.

3. A tool holder as claimed in claim 2 wherein the holster portion is connected to a flat side of the D ring and the belt loop portion is connected to a semi-circular side of the D ring.

4. A tool holder for use by fishermen, handymen and the like comprising:

a holster portion having a pocket of a size for holding a tool, the pocket being formed from a front and base connected together along the sides thereof and having an open top, wherein the sides of the front and base forming the pocket taper from the top to an bottom, the holster portion being constructed of a soft material and the base near the top being provided with stiffening means to provide stiffness to substantially reduce bending or folding when a tool is inserted or removed from the pocket, a belt loop portion for attaching the holder to the belt of a user, the holster portion and the belt loop portion each being movably attached to a connecting means, the holster portion being suspended from the belt loop portion through the connecting means to allow the holster portion movement from front to back and from side to side simultaneously such that the holster portion remains suspended by the connecting means below the belt loop portion in a generally vertical orientation independent of the movement of a user thereby reducing the possibility of interference of the holster to freedom of movement of the user.

5. A tool holder as claimed in claim 4 wherein the stiffening means is provided by a piece of relatively stiff polyolefin or other plastic attached to the base.

6. A tool holder as claimed in claim 5 wherein the connecting means between the holster and belt loop portions is provided by a D ring connecting the two portions together.

7. A tool holder as claimed in claim 6 wherein the holster portion is connected to a flat side of the D ring and the belt loop portion is connected to a semi-circular side of the D ring.

8. A tool holder for use by fishermen, handymen and the like comprising:

a holster portion having a pocket of a size for holding a tool, the pocket being formed from a front and base connected together along the sides thereof and having an open top, wherein the sides of the front and base forming the pocket taper from the top to an bottom, a belt loop portion for attaching the holder to the belt of a user, the holster portion and the belt loop portion each being movably attached to movable connection, the movable connection allowing the holster portion movement from front to back and from side to side simultaneously such that the holster portion remains suspended by the movable connection below the belt loop portion in a generally vertical orientation independent of the movement of a user, the belt loop portion comprising a lower end having a means for engaging the moveable connection and further including a first part of a two-part releasable securing means to the back of the lower end, the belt loop portion further including a loop portion for engagement with a belt extending upwardly and rearwardly of the lower end and ending in a grasping end, the second part of the two-part releasable securing means being attached to the inside of the loop portion near the grasping end, whereby when the belt loop portion is attached to a belt, the grasping end and two-part releasable securing means are located between the loop portion and the wearer of the belt thereby protecting the releasable securing means from accidental disengagement or interference with operation of the holder.

9. A tool holder for use by fishermen, handymen and the like comprising:

a holster portion having a pocket of a size for holding a tool, the pocket being formed from a front and base connected together along the sides thereof and having an open top, wherein the sides of the front and base forming the pocket taper from the top to an bottom, a belt loop portion for attaching the holder to the belt of a user, the holster portion being suspended from the belt loop portion through a connecting means having a semicircular ring extending upwardly from the holster portion, the belt loop portion having a lower end connected to the semicircular ring to permit the semicircular ring to move freely along its length and to pivot within the lower end of the belt loop portion, whereby the holster portion is able to move from front to back and from side to side simultaneously such that the holster portion remains suspended by the connecting means below the belt loop portion in a generally vertical orientation independent of the movement of a user thereby reducing the possibility of interference of the holster to freedom of movement of the user.

10. A tool holder as claimed in claim 9 wherein the holster portion is constructed of a soft material and the base near the top being provided with stiffening means to provide stiffness to substantially reduce bending or folding when a tool is inserted or removed from the pocket.

11. A tool holder as claimed in claim 10 wherein the stiffening means is provided by a piece of relatively stiff polyolefin or other plastic attached to the base.

12. A tool holder as claimed in claim 9 wherein the belt loop portion comprises a lower end having a means for engaging the moveable connection and further including a first part of a two-part releasable securing means to the back of the lower end, the belt loop portion further including a loop portion for engagement with a belt extending upwardly and rearwardly of the lower end and ending in a grasping end, the second part of the two-part releasable securing means being attached to the inside of the loop portion near the grasping end, whereby when the belt loop portion is attached to a belt, the grasping end and two-part releasable securing means are located between the loop portion and the wearer of the belt thereby protecting the releasable securing means from accidental disengagement or interference with operation of the holder.

* * * * *